US011838741B2

(12) United States Patent
Sun et al.

(10) Patent No.: US 11,838,741 B2
(45) Date of Patent: Dec. 5, 2023

(54) IN-VEHICLE INDEPENDENT SOUND ZONE CONTROL METHOD, SYSTEM AND RELATED DEVICE

(71) Applicant: AAC Microtech (Changzhou) Co., Ltd., Changzhou (CN)

(72) Inventors: Shuyuan Sun, Shenzhen (CN); Yiming Meng, Shenzhen (CN); Hao Yin, Shenzhen (CN); Henglizi Zhang, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/830,364

(22) Filed: Jun. 2, 2022

(65) Prior Publication Data

US 2023/0217200 A1 Jul. 6, 2023

(30) Foreign Application Priority Data

Dec. 31, 2021 (CN) ..... 202111671087.1

(51) Int. Cl.

| | |
|---|---|
| ***H04S 7/00*** | (2006.01) |
| ***H04R 1/02*** | (2006.01) |
| ***H04R 1/40*** | (2006.01) |
| ***H04R 5/02*** | (2006.01) |

(52) U.S. Cl.

CPC ..... *H04S 7/30* (2013.01); *H04R 1/025* (2013.01); *H04R 1/403* (2013.01); *H04R 5/02* (2013.01); *H04R 2201/401* (2013.01); *H04R 2201/403* (2013.01); *H04R 2499/13* (2013.01); *H04S 2400/11* (2013.01); *H04S 2420/01* (2013.01)

(58) Field of Classification Search

CPC .... H04S 7/30; H04S 2400/11; H04S 2420/01; H04R 1/025; H04R 1/403; H04R 5/02; H04R 2201/401; H04R 2201/403; H04R 2499/13

See application file for complete search history.

(56) References Cited

U.S. PATENT DOCUMENTS

| | | | | |
|---|---|---|---|---|
| 2004/0196982 | A1* | 10/2004 | Aylward | H04S 3/00 381/387 |
| 2009/0154713 | A1* | 6/2009 | Kamiya | H04S 7/302 381/1 |
| 2017/0013385 | A1* | 1/2017 | Vautin | H04S 5/00 |

* cited by examiner

*Primary Examiner* — Jason R Kurr
(74) *Attorney, Agent, or Firm* — W&G Law Group

(57) ABSTRACT

The present disclosure discloses an in-vehicle independent sound zone control method, a system and a related device, applied to a vehicle. The method includes the following steps: presetting a control area and a non-control area; arranging a speaker array behind a front seat of the vehicle for generating a first acoustic response, and arranging a headrest speaker at a headrest on a rear seat of the vehicle for generating a second acoustic response; fitting a virtual target speaker, wherein the virtual target speaker is configured to generate a target acoustic response within the control area; and controlling a sound quality of the in-vehicle independent sound zone through an audio algorithm processing on the target acoustic response, the first acoustic response and the second acoustic response.

4 Claims, 5 Drawing Sheets

IN-VEHICLE INDEPENDENT SOUND ZONE CONTROL METHOD, SYSTEM AND RELATED DEVICE

TECHNICAL FIELD

The present disclosure relates to the technical field of in-vehicle entertainment, in particular to an in-vehicle independent sound zone control method, an in-vehicle independent sound zone control system, an electronic device and a computer-readable storage medium.

BACKGROUND

With the rapid development of automotive technologies, technological updates of smart cockpits have provided users with a lot of higher-quality user experiences, and an excellent vehicle-mounted audio and video entertainment system has already been an indispensable part of providing a superior driving experience. However, more and more users are no longer satisfied with high-quality and high-fidelity vehicle audio, and prefer a personalized in-vehicle sound experience. That is, passengers in each position in the vehicle have different requirements for sound quality and listening content. The new user experience direction is that passengers can freely choose the sound that they need to hear without interfering with each other in each position.

In the related art, a vehicle-mounted audio system includes a vehicle entertainment device, a power amplifier and a speaker. The speak is adjusted by a front cab or a co-pilot to make sound and the sound is transmitted to the entire vehicle interior space.

However, in the related art, no good partition effect can be achieved. In one of the relate art, the partition is achieved by a headrest anti-phase sound source cancellation or an original in-vehicle speakers. However, the separation between various sound zones is not enough, especially, the partition effect is not obvious enough in the middle and high frequency bands. In the other one of the related art, the partition is achieved by a speaker directional control. However, there is a poor performance in sound quality, resulting in a poor actual acoustic experience for passengers.

Therefore, it is necessary to provide a new in-vehicle independent sound zone control method, a system and a device to solve the above-mentioned technical problem.

SUMMARY

An object of the present disclosure is to solve the above-mentioned technical problem, and provide an in-vehicle independent sound zone control method, an in-vehicle independent sound zone control system, an electronic device and a computer-readable storage medium.

In order to achieve the above-mentioned object, in a first aspect, an embodiment of the present disclosure provides an in-vehicle independent sound zone control method, applied to a vehicle, comprising:

presetting a control area and a non-control area, wherein the control area is a listening area where a passenger is located in the vehicle and an in-vehicle independent sound zone is formed, and the non-control area is a remaining area in the vehicle except the control area;

arranging a speaker array behind a front seat of the vehicle for generating a first acoustic response, and arranging a headrest speaker at a headrest on a rear seat of the vehicle for generating a second acoustic response;

fitting a virtual target speaker, wherein the virtual target speaker is configured to generate a target acoustic response within the control area; and controlling a sound quality of the in-vehicle independent sound zone through an audio algorithm processing on the target acoustic response, the first acoustic response and the second acoustic response.

In some embodiments, the speaker array comprises a plurality of speaker units, and the plurality of speaker units comprise a linear array and a circular array.

In some embodiments, the audio algorithm processing comprises a sound zone isolation processing and a sound zone sound quality optimization processing.

In some embodiments, the sound zone isolation processing comprises:

maximizing a difference between the first acoustic response in the control area and the first acoustic response in the non-control area, and maximizing a difference between the second acoustic response in the control area and the second acoustic response in the non-controlled region.

In some embodiments, the sound zone sound quality optimization processing comprises:

performing a response fitting on the first acoustic response, the second acoustic response and the target acoustic response.

In some embodiments, the step of fitting the virtual target speaker is specifically:

presetting a target position in the control area to fit a virtual speaker; comprehensively superimposing the first acoustic response and the second acoustic response within the preset target position of the control area, so as to realize the target acoustic response generated by the virtual speaker.

In some embodiments, the response fitting is obtained by simultaneously combining a relationship between the target acoustic response and a transfer function.

In a second aspect, an embodiment of the present disclosure provides an in-vehicle independent sound zone control system, comprising a preset control module, a generating response module, a predetermining target module and a processing module;

wherein the preset control module is configured to preset a control area and a non-control area, wherein the control area is a listening area where a passenger is located in the vehicle and an in-vehicle independent sound zone is formed, and the non-control area is a remaining area in the vehicle except the control area;

the generating response module is configured to arrange a speaker array behind a front seat of the vehicle for generating a first acoustic response, and arrange a headrest speaker at a headrest on a rear seat of the vehicle for generating a second acoustic response;

the predetermining target module is configured to fit a virtual target speaker, wherein the virtual target speaker is configured to generate a target acoustic response within the control area; and the processing module is configured to control a sound quality of the in-vehicle independent sound zone through an audio algorithm processing on the target acoustic response, the first acoustic response and the second acoustic response.

In a third aspect, an embodiment of the present disclosure provides an electronic device, comprising a processor and a memory; wherein the memory stores computer instructions executable by the processor, and when the processor reads the computer instructions in the memory, steps in the above-mentioned in-vehicle independent sound zone control method are executed.

In a fourth aspect, an embodiment of the present disclosure provides a computer-readable storage medium, having stored therein computer instructions, wherein when the computer instructions are executed by a processor, steps in the above-mentioned in-vehicle independent sound zone control method are executed.

Compared with the related art, in the in-vehicle independent sound zone control method method, the system, the electronic device and the computer-readable storage medium of the present disclosure, a control zone and a non-control zone are preset; a speaker array is arranged behind the front seat of the vehicle for generating a first acoustic response, and a headrest speaker is arranged at the headrest on the rear seat of the vehicle for generating a second acoustic response; a virtual target speaker is fitted, in which the virtual target speaker is configured to generate a target acoustic response within the control area; and a sound quality of the in-vehicle independent sound zone is controlled through an audio algorithm processing on the target acoustic response, the first acoustic response and the second acoustic response. In the above method, the speaker array and the headrest speaker are arranged in the vehicle, and the acoustic responses of the speaker array and the headrest speakers are subjected to the audio algorithm processing, so as to optimize the sound quality in the control area under the condition of satisfying a partition of the in-vehicle independent sound zone, thereby providing a better acoustic user experience.

BRIEF DESCRIPTION OF THE DRAWINGS

In order to describe the technical solutions in the embodiments of the present disclosure more clearly, accompanying drawings required to be used in the descriptions of the embodiments will be briefly introduced below. Obviously, the drawings in the illustration below are merely some embodiments of the present disclosure. Those ordinarily skilled in the art also can acquire other drawings according to the provided drawings without doing creative work.

DETAILED DESCRIPTION OF THE EMBODIMENTS

The technical solutions in the embodiments of the present disclosure will be described clearly and completely below with reference to the drawings in the embodiments of the present disclosure. Obviously, the embodiments described herein are only part of the embodiments of the present disclosure, not all the embodiments. Based on the embodiments in the present disclosure, all other embodiments obtained by those of ordinary skill in the art without creative work shall fall within the protection scope of the present disclosure.

The present disclosure provides an in-vehicle independent sound zone control method, which is applied to a vehicle.

An independent sound zone is arranged inside the vehicle, and the independent sound zone is a sound scene of a target environment audibly created in the vehicle. That is to say, the independent sound zone creates a sound scene of the target environment auditorily for the passengers.

Figure 1:
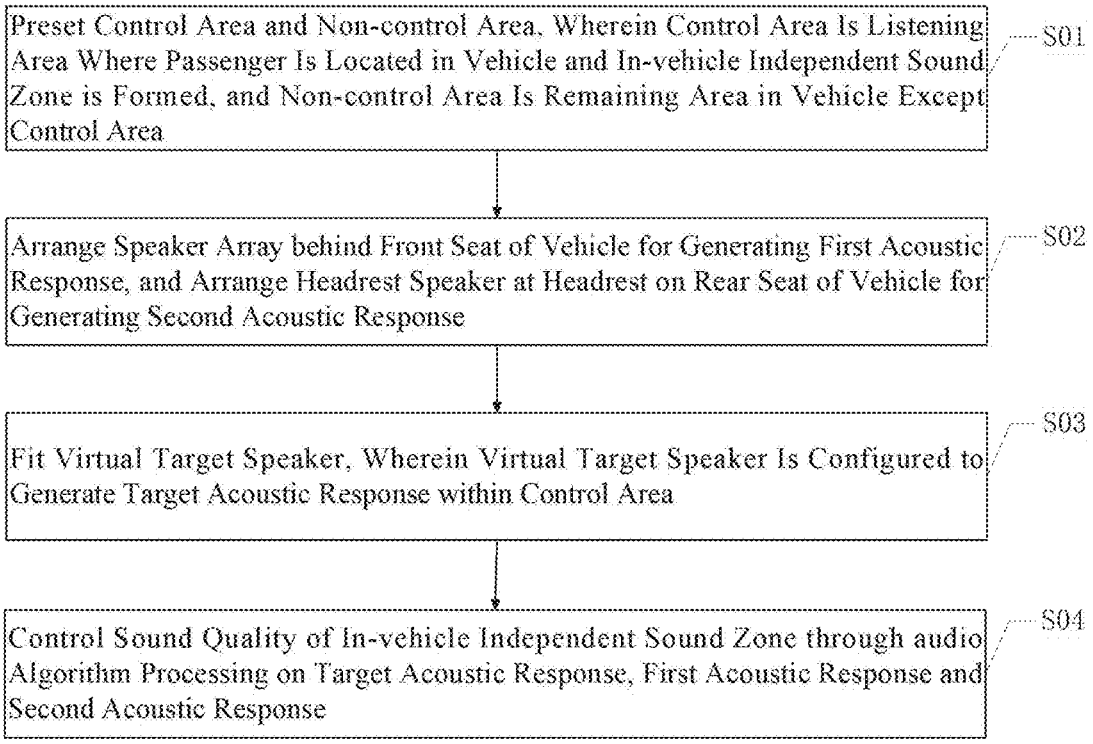
FIG. 1 is a flowchart of an in-vehicle independent sound zone control method according to an embodiment of the present disclosure.
Figure 2:
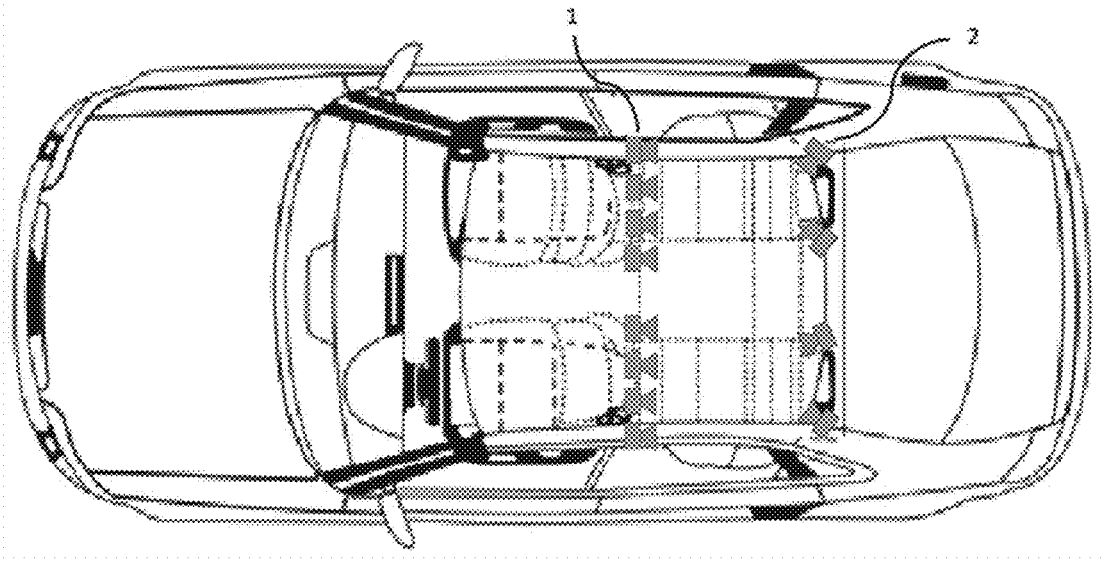
FIG. 2 is a layout diagram of a speaker of the in-vehicle independent sound zone control method according to an embodiment of the present disclosure.

Referring to FIG. 1, FIG. 1 is a flowchart of an in-vehicle independent sound zone control method according to an embodiment of the present disclosure.

The in-vehicle independent sound zone control method includes the following steps.

S01: a control area 9 and a non-control area 10 are preset. The control area 9 refers to a listening area where passengers in the vehicle is located, to form an in-vehicle independent sound zone. The non-control area 10 refers to the remaining area in the vehicle except the control area. A target passenger in the vehicle generally sits in the control area 9, and it is convenient for the target passenger to perform the independent sound zone control through the control area 9.

S02: a speaker array is arranged behind a front seat of the vehicle for generating a first acoustic response, a headrest speaker is arranged at a headrest of a rear seat of the vehicle for generating a second acoustic response response.

Specifically, the control area 9 is located between a back of the front seat and the rear seat, and actually belongs to a position where the target passenger sits. By arranging the speaker array 1 behind the front seats of the vehicle, and arranging the headrest speakers 2 on the rear seats, the first acoustic response and the second acoustic response are respectively generated by the original sound signals emitted by the speaker array 1 and the headrest speakers 2, so that the target passenger hears good acoustic performance.

Since there are two rear seats and the target passenger is located in the control area 9, the control area 9 and the non-control area 10 may be selected according to the position of the target passenger.

S03: a virtual target speaker is fitted, in which the virtual target speaker is configured to generate a target acoustic response in the control area.

Specifically, the target speaker refers to a hypothetical virtual speaker, which may be, but is not limited to, a speaker located directly in front of the user.

S04: a sound quality of the in-vehicle independent sound zone is controlled through an audio algorithm processing on the target acoustic response, the first acoustic response and the second acoustic response.

In this way, the acoustic responses of the speaker array 1 and the headrest speakers 2 are subjected to the audio algorithm processing, and the sound quality in the control area 9 is optimized under the condition of satisfying the condition of a partition of the in-vehicle independent sound zone, thereby providing a better acoustic user experience.

In this embodiment, the speaker array 1 includes a plurality of speaker units, and the plurality of speaker units include a line array and a circular array. By providing the plurality of speaker units or the plurality of speaker modules, the headrest speaker 2 also includes a plurality of speaker units or a plurality of speaker modules. The sound signals emitted by the plurality of speaker units are subjected to the audio algorithm processing, thereby achieving a good sound quality effect and a good user experience.

Figure 3:
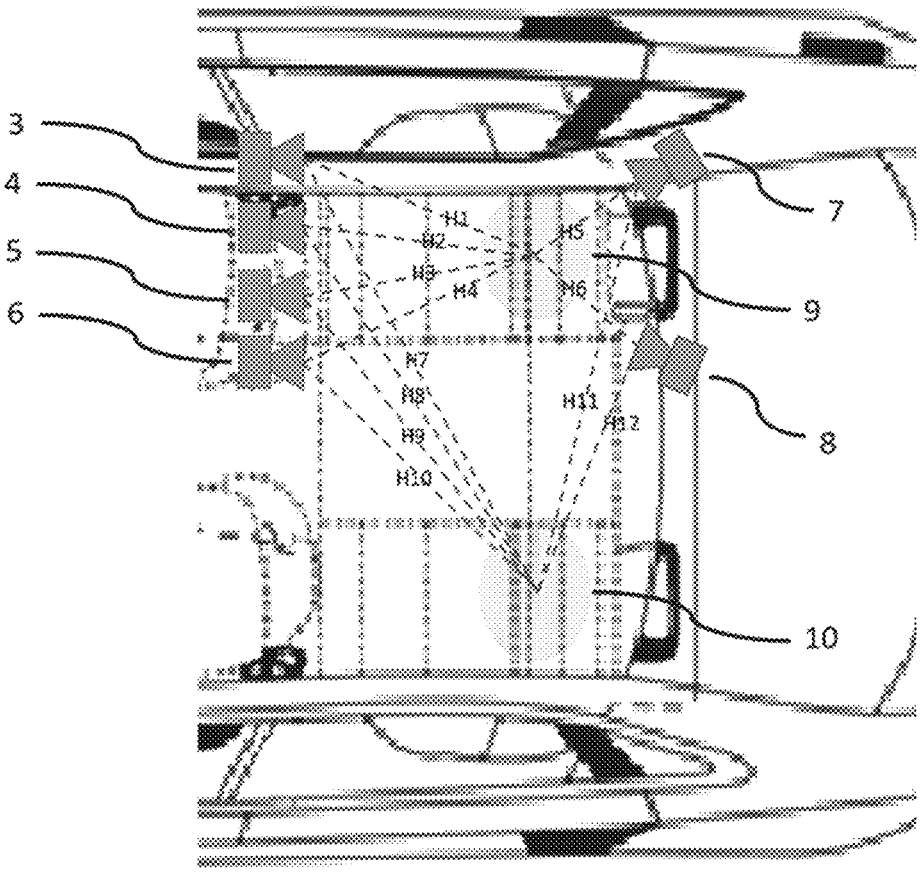
FIG. 3 is a layout diagram of the speaker of the in-vehicle independent sound zone control method according to an embodiment of the present disclosure.
Figure 4:
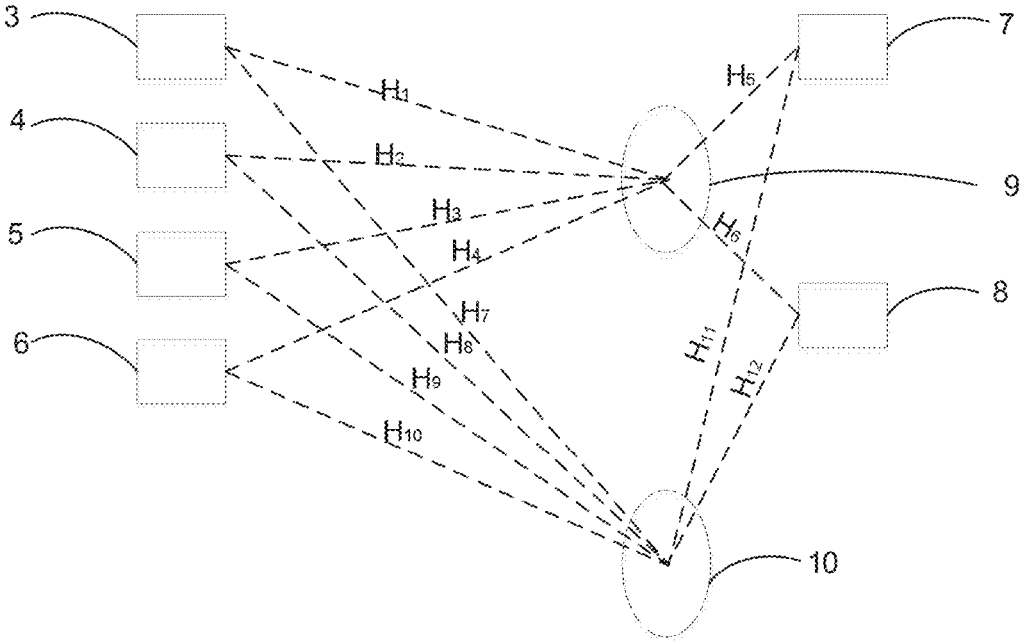
FIG. 4 is a layout module diagram of the speaker of the in-vehicle independent sound zone control method according to an embodiment of the present disclosure.
Figure 5:
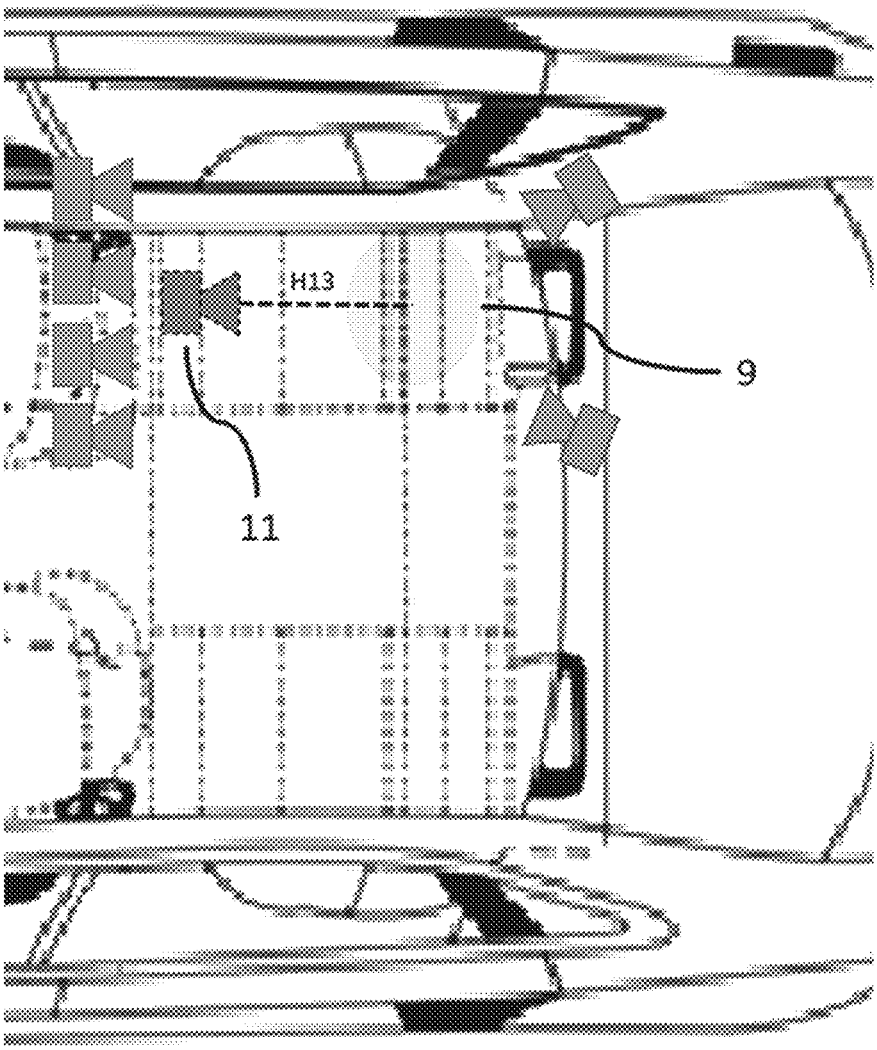
FIG. 5 is a layout diagram of a virtual speaker of the in-vehicle independent sound zone control method according to an embodiment of the present disclosure.

Referring to FIGS. 2-5, FIG. 2 is a layout diagram of a speaker of the in-vehicle independent sound zone control method according to an embodiment of the present disclosure. FIG. 3 is a layout diagram of the speaker of the in-vehicle independent sound zone control method according to an embodiment of the present disclosure. FIG. 4 is a layout module diagram of the speaker of the in-vehicle independent sound zone control method according to an embodiment of the present disclosure. FIG. 5 is a layout diagram of a virtual speaker of the in-vehicle independent sound zone control method according to an embodiment of the present disclosure.

In this embodiment, the sound partition of the left and right positions of the rear seat is realized by the speaker array 1 arranged behind the front seat and the headrest speaker 2 arranged at the headrest position of the rear seat. The speaker array 1 consists of four speaker modules. The speaker in this embodiment adopts a moving-coil full-band miniature vehicle speaker with a size of 30×60×12 mm, and other types or sizes of speakers may also be adopted.

Specifically, the speaker array 1 in the front row includes a speaker 3, a speaker 4, a speaker 5, and a speaker 6. The headrest speaker 2 includes a speaker 7 and a speaker 8. For passengers on a right side of the rear row, a position on the right side of the rear row is the control area 9, and a position on the left side of the rear row is the non-control area 10. In this embodiment, the audio algorithm processing at the right position of the rear row is taken as an example (the left position is symmetrical to the right position, and the processing method is the same), and the process of the above audio algorithm processing is described in detail.

As shown in FIGS. 3-4, $H_1$~$H_{12}$ represent an acoustic transfer function of the sound from each speaker shown in FIGS. 3-4 propagating to the control area 9 and the non-control area 10. The transfer function refers to a ratio of a Laplace transform (or z-transform) of the response (i.e., output) of a linear system to a Laplace transform of an excitation (i.e., input) under a zero initial condition. The transfer function is denoted as H=Y/U, in which Y and U are the Laplace transform of output and the Laplace transform of input, respectively. The transfer function is one of the basic mathematical tools to describe dynamic characteristics of the linear system, and one of the main tools to study classical control theory. The transfer function in this embodiment may be obtained by directly measuring the practical in-vehicle situation.

It is assumed that the original sound signal is S, and the sound signals given to the speaker 3, the speaker 4, the speaker 5, the speaker 6, the speaker 7, the speaker 8, and the speaker 9 are processed signals of the original signal S, which are respectively S1, S2, S3, S4, S5 and S6. The acoustic response generated in the control area 9 by the first acoustic response and the second acoustic response is:

$$S1\cdot H_1+S2\cdot H_2+S3\cdot H_3+S4\cdot H_4+S5\cdot H_5+S6\cdot H_6.$$

The acoustic responses is written in a matrix form as follows.

$$[S1\ \ S2\ \ S3\ \ S4\ \ S5\ \ S6]\begin{bmatrix} H_1 \\ H_2 \\ H_3 \\ H_4 \\ H_5 \\ H_6 \end{bmatrix}$$

The acoustic response generated in the non-control area 10 by the first acoustic response and the second acoustic response is:

$$S1\cdot H_7+S2\cdot H_8+S3\cdot H_9+S4\cdot H_{10}+S5\cdot H_{11}+S6\cdot H_{12}$$

The acoustic responses is written in a matrix form as follows.

$$[S1\ \ S2\ \ S3\ \ S4\ \ S5\ \ S6]\begin{bmatrix} H_7 \\ H_8 \\ H_9 \\ H_{10} \\ H_{11} \\ H_{12} \end{bmatrix}$$

The acoustic responses of the speaker array 1 and the headrest speakers 2 are subjected to the audio algorithm processing, so that the sound quality in the control area is optimized under the condition of satisfying a partition of the in-vehicle independent sound zone, thereby providing a better acoustic user experience.

In this embodiment, the audio algorithm processing includes a sound zone isolation processing and a sound zone sound quality optimization processing.

Specifically, the sound zone isolation processing includes: maximizing a difference between the first acoustic response in the control area and the first acoustic response in the non-control area, and maximizing a difference between the second acoustic response in the control area and the second acoustic response in the non-controlled region.

Specifically, the virtual speaker 11 is located directly in front of the control area 9. It should be noted that the virtual speaker 11 is only configured to measure and determine the target acoustic response. In practical use, there is no speaker in this position. In addition, the position of the virtual speaker may be adjusted according to the designer's requirements, including but not limited to a position in front of the passenger, a position of the headrest, or a position of the front center console. In this embodiment, the position directly in front of the control area is selected as the position of the virtual speaker 11, then the target acoustic response in the control area 9 is: $S\cdot H_{13}$.

S is an original sound signal, and $H_{13}$ is an acoustic transfer function of the sound emitted by the virtual speaker 11 propagating into the control area 9.

The sound signals given to the speaker 3, the speaker 4, the speaker 5, the speaker 6, the speaker 7, the speaker 8 and the speaker 9 are the signals after the original signal S being subject to the audio algorithm processing, which are respectively S1, S2, S3, S4, S5 and S6. The audio algorithm processing satisfies two part of optimization conditions as follows.

The sound zone isolation processing:

$$\mathrm{Max}\left\{\left|[S1\ \ S2\ \ S3\ \ S4\ \ S5\ \ S6]\begin{bmatrix} H_1 \\ H_2 \\ H_3 \\ H_4 \\ H_5 \\ H_6 \end{bmatrix} -\right.\right.$$

-continued $$\left\| [S1 \quad S2 \quad S3 \quad S4 \quad S5 \quad S6] \begin{bmatrix} H_7 \\ H_8 \\ H_9 \\ H_{10} \\ H_{11} \\ H_{12} \end{bmatrix} \right\|\Bigg\}$$

represents a modulo value of a computed vector. Through the part of processing optimization, the difference between the acoustic response of the control area 9 and the acoustic response the non-control area 10 can be maximized, so as to achieve a relatively ideal sound zone isolation.

Specifically, the sound zone sound quality optimization processing includes: performing a response fitting on the control acoustic response of the control area and the non-control acoustic response of the non-control area to the target response.

In this embodiment, step S03 includes the following steps.

A target position is preset in the control area to fit a virtual speaker. The first acoustic response and the second acoustic response within the preset target position of the control area are comprehensively superimposed, so as to realize the target acoustic response generated by the virtual speaker.

In this embodiment, the fitting response is obtained by simultaneously combining a relationship between the target acoustic response and a transfer function.

Specifically, the virtual speaker 11 is located directly in front of the control area 9. It should be noted that the virtual speaker 11 is only configured to measure and determine the target acoustic response. In practical use, there is no speaker in this position. In addition, the position of the virtual speaker may be adjusted according to the designer's requirements, including but not limited to a position in front of the passenger, a position of the headrest, or a position of the front center console. In this embodiment, the position directly in front of the control area is selected as the position of the virtual speaker 11, then the target acoustic response in the control area 9 is: $S \cdot H_{13}$.

S is an original sound signal, and $H_{13}$ is an acoustic transfer function of the sound emitted by the virtual speaker 11 propagating into the control area 9.

Specifically, the sound zone sound quality optimization processing is as follows.

$$\mathrm{Min}\left\{\left\| [S1 \quad S2 \quad S3 \quad S4 \quad S5 \quad S6] \begin{bmatrix} H_1 \\ H_2 \\ H_3 \\ H_4 \\ H_5 \\ H_6 \end{bmatrix} - S \cdot H_{13} \right\|\right\}$$

represents a modulo value of a computed vector. Through the part of optimization, the superimposed acoustic response of the speaker array 1 and the headrest speaker 2 in the control area 9 can be close to the acoustic response of the virtual speaker 11 in the control area 9, so as to achieve the purpose of optimizing the sound quality and adjusting the sound field and image in the control area 9.

By calculating the optimal solution under the above two optimization conditions, the sound signals S1, S2, S3, S4, S5, and S6 actually loaded on the speaker 3, the speaker 4, the speaker 5, the speaker 6, the speaker 7 and the speaker 8 obtained after the original sound signal S being subject to the audio algorithm processing may be calculated. Similarly, the speaker array 1 and the headrest speaker 2 on the left side of the rear row use the same optimization process to calculate the sound signal after the audio algorithm processing.

Figure 6:
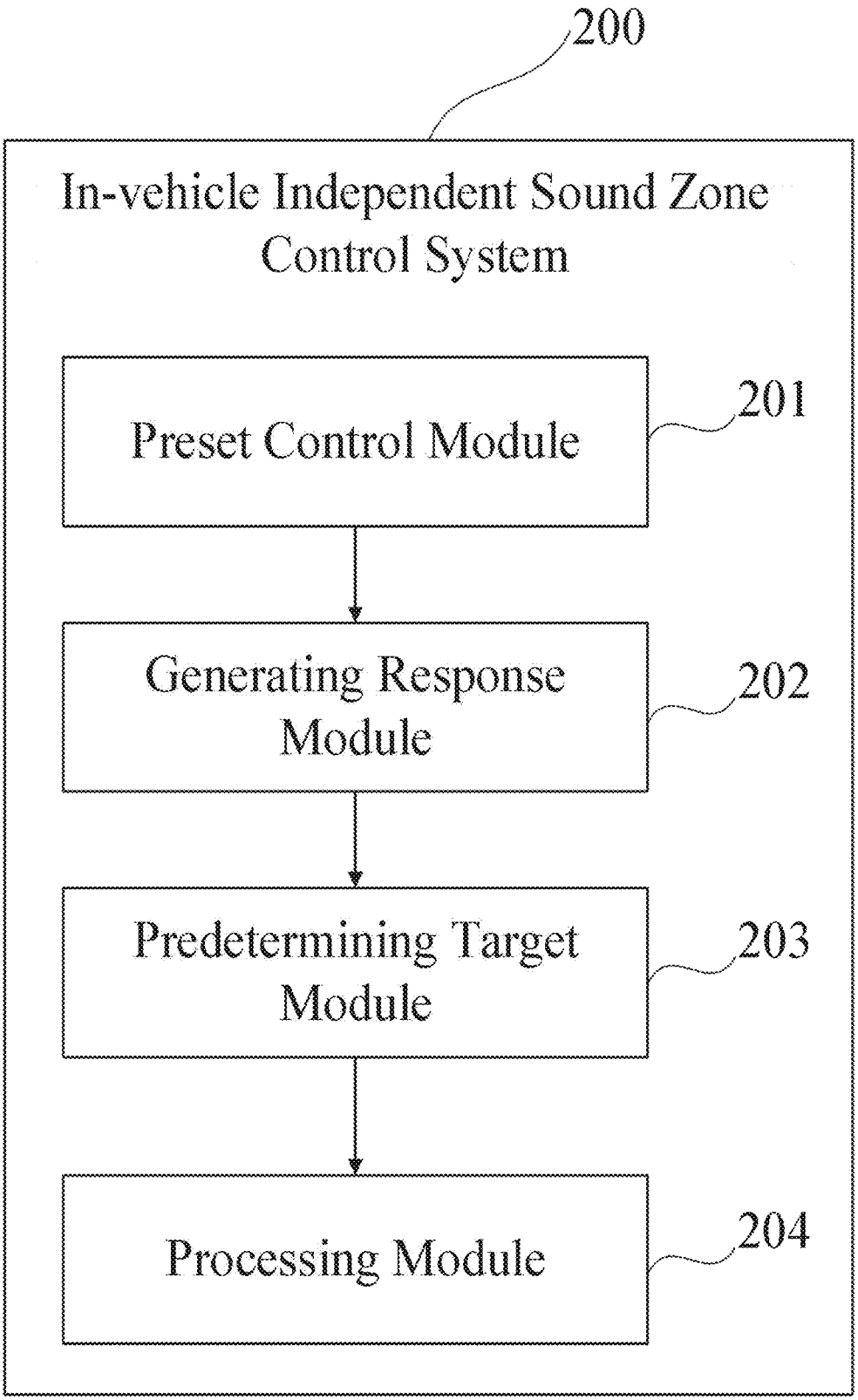
FIG. 6 is a structural block diagram of an in-vehicle independent sound zone control device according to an embodiment of the present disclosure.

In the second aspect, referring to FIG. 6, FIG. 6 is a structural block diagram of an in-vehicle independent sound zone control device according to an embodiment of the present disclosure. An embodiment of the present disclosure further provides an in-vehicle independent sound zone control system 200, including a preset control module 201, a generating response module 202, a predetermining target module 203, and a processing module 204.

The preset control module 201 is configured to preset a control area 9 and a non-control area 10. The control area refers to a listening area where a passenger is located in the vehicle and and an in-vehicle independent sound zone is formed. The non-control area is a remaining area in the vehicle except the control area.

The generating response module 202 is configured to arrange a speaker array behind a front seat of the vehicle for generating a first acoustic response, and arrange a headrest speaker at a headrest on a rear seat of the vehicle for generating a second acoustic response.

The predetermining target module 203 is configured to fit a virtual target speaker. The virtual target speaker is configured to generate a target acoustic response within the control area.

The processing module 204 is configured to control a sound quality of the in-vehicle independent sound zone through an audio algorithm processing on the target acoustic response, the first acoustic response and the second acoustic response. The target acoustic response, the first acoustic response and the second acoustic response are processed by an audio algorithm processing to control the in-vehicle independent sound zone. In this way, the acoustic responses of the speaker array 1 and the headrest speakers 2 are subjected to the audio algorithm processing, so the sound quality in the control area 9 is optimized under the condition of satisfying a partition of the in-vehicle independent sound zone, thereby providing a better acoustic user experience.

In this embodiment, the speaker array 1 includes a plurality of speaker units, and the plurality of speaker units include a line array and a circular array. By providing the plurality of speaker units or the plurality of speaker modules, the headrest speaker 2 also includes a plurality of speaker units or a plurality of speaker modules. The sound signals emitted by the plurality of speaker units are subjected to the audio algorithm processing, thereby achieving a good sound quality effect and a good user experience.

In this embodiment, the sound partition of the left and right positions of the rear seat is realized by the speaker array 1 arranged behind the front seat and the headrest speaker 2 arranged at the headrest position of the rear seat. The speaker array 1 consists of four speaker modules. The speaker in this embodiment adopts a moving-coil full-band miniature vehicle speaker with a size of 30×60×12 mm, and other types or sizes of speakers may also be adopted.

Specifically, the speaker array 1 in the front row includes a speaker 3, a speaker 4, a speaker 5, and a speaker 6. The headrest speaker 2 includes a speaker 7 and a speaker 8. For passengers on a right side of the rear row, a position on the right side of the rear row is the control area 9, and a position on the left side of the rear row is the non-control area 10. In this embodiment, the audio algorithm processing at the right position of the rear row is taken as an example (the left position is symmetrical to the right position, and the processing method is the same), and the process of the above audio algorithm processing is described in detail.

As shown in FIGS. 3-4, $H_1 \sim H_{12}$ represent an acoustic transfer function of the sound from each speaker shown in FIGS. 3-4 propagating to the control area 9 and the non-control area 10. The transfer function refers to a ratio of a Laplace transform (or z-transform) of the response (i.e., output) of a linear system to a Laplace transform of an excitation (i.e., input) under a zero initial condition. The transfer function is denoted as H=Y/U, in which Y and U are the Laplace transform of output and the Laplace transform of input, respectively. The transfer function is one of the basic mathematical tools to describe dynamic characteristics of the linear system, and one of the main tools to study classical control theory. The transfer function in this embodiment may be obtained by directly measuring the practical in-vehicle situation.

It is assumed that the original sound signal is S, and the sound signals given to the speaker 3, the speaker 4, the speaker 5, the speaker 6, the speaker 7, the speaker 8, and the speaker 9 are processed signals of the original signal S, which are respectively S1, S2, S3, S4, S5 and S6. The acoustic responses generated in the control area 9 by the first acoustic response and the second acoustic response are:

$$S1 \cdot H_1 + S2 \cdot H_2 + S3 \cdot H_3 + S4 \cdot H_4 + S5 \cdot H_5 + S6 \cdot H_6.$$

The acoustic responses is written in a matrix form as follows.

$$[S1 \quad S2 \quad S3 \quad S4 \quad S5 \quad S6] \begin{bmatrix} H_1 \\ H_2 \\ H_3 \\ H_4 \\ H_5 \\ H_6 \end{bmatrix}$$

The acoustic response generated in the non-control area 10 by the first acoustic response and the second acoustic response is:

$$S1 \cdot H_7 + S2 \cdot H_8 + S3 \cdot H_9 + S4 \cdot H_{10} + S5 \cdot H_{11} + S6 \cdot H_{12}$$

The acoustic responses is written in a matrix form as follows.

$$[S1 \quad S2 \quad S3 \quad S4 \quad S5 \quad S6] \begin{bmatrix} H_7 \\ H_8 \\ H_9 \\ H_{10} \\ H_{11} \\ H_{12} \end{bmatrix}$$

The acoustic responses of the speaker array 1 and the headrest speakers 2 are subjected to the audio algorithm processing, so that the sound quality in the control area is optimized under the condition of satisfying a partition of the in-vehicle independent sound zone, thereby providing a better acoustic user experience.

In this embodiment, the audio algorithm processing includes a sound zone isolation processing and a sound zone sound quality optimization processing.

Specifically, the sound zone isolation processing includes: maximizing a difference between the first acoustic response in the control area and the first acoustic response in the non-control area, and maximizing a difference between the second acoustic response in the control area and the second acoustic response in the non-controlled region.

Specifically, the virtual speaker 11 is located directly in front of the control area 9. It should be noted that the virtual speaker 11 is only configured to measure and determine the target acoustic response. In practical use, there is no speaker in this position. In addition, the position of the virtual speaker may be adjusted according to the designer's requirements, including but not limited to a position in front of the passenger, a position of the headrest, or a position of the front center console. In this embodiment, the position directly in front of the control area is selected as the position of the virtual speaker 11, then the target acoustic response in the control area 9 is: $S \cdot H_{13}$.

S is an original sound signal, and $H_{13}$ is an acoustic transfer function of the sound emitted by the virtual speaker 11 propagating into the control area 9.

The sound signals given to the speaker 3, the speaker 4, the speaker 5, the speaker 6, the speaker 7, the speaker 8 and the speaker 9 are the signals after the original signal S being subject to the audio algorithm processing, which are respectively S1, S2, S3, S4, S5 and S6. The audio algorithm processing satisfies two part of optimization conditions as follows.

The sound zone isolation processing:

$$\mathrm{Max}\left\{\left\| [S1 \quad S2 \quad S3 \quad S4 \quad S5 \quad S6] \begin{bmatrix} H_1 \\ H_2 \\ H_3 \\ H_4 \\ H_5 \\ H_6 \end{bmatrix} - [S1 \quad S2 \quad S3 \quad S4 \quad S5 \quad S6] \begin{bmatrix} H_7 \\ H_8 \\ H_9 \\ H_{10} \\ H_{11} \\ H_{12} \end{bmatrix} \right\|\right\}$$

$\|\cdot\|$ represents a modulo value of a computed vector. Through the part of processing optimization, the difference between the acoustic response of the control area 9 and the acoustic response the non-control area 10 can be maximized, so as to achieve a relatively ideal sound zone isolation.

The sound zone sound quality optimization processing is as follows.

$$\mathrm{Min}\left\{\left\| [S1 \quad S2 \quad S3 \quad S4 \quad S5 \quad S6] \begin{bmatrix} H_1 \\ H_2 \\ H_3 \\ H_4 \\ H_5 \\ H_6 \end{bmatrix} - S \cdot H_{13} \right\|\right\}$$

$\|\cdot\|$ represents a modulo value of a computed vector. Through the part of optimization, the superimposed acoustic response of the speaker array 1 and the headrest speaker 2 in the control area 9 can be close to the acoustic response of the virtual speaker 11 in the control area 9, so as to achieve the purpose of optimizing the sound quality and adjusting the sound field and image in the control area 9.

By calculating the optimal solution under the above two optimization conditions, the sound signals S1, S2, S3, S4, S5, and S6 actually loaded on the speaker 3, the speaker 4, the speaker 5, the speaker 6, the speaker 7 and the speaker 8 obtained after the original sound signal S being subject to the audio algorithm processing may be calculated. Similarly, the speaker array 1 and the headrest speaker 2 on the left side of the rear row use the same optimization process to calculate the sound signal after the audio algorithm processing.

Figure 7:
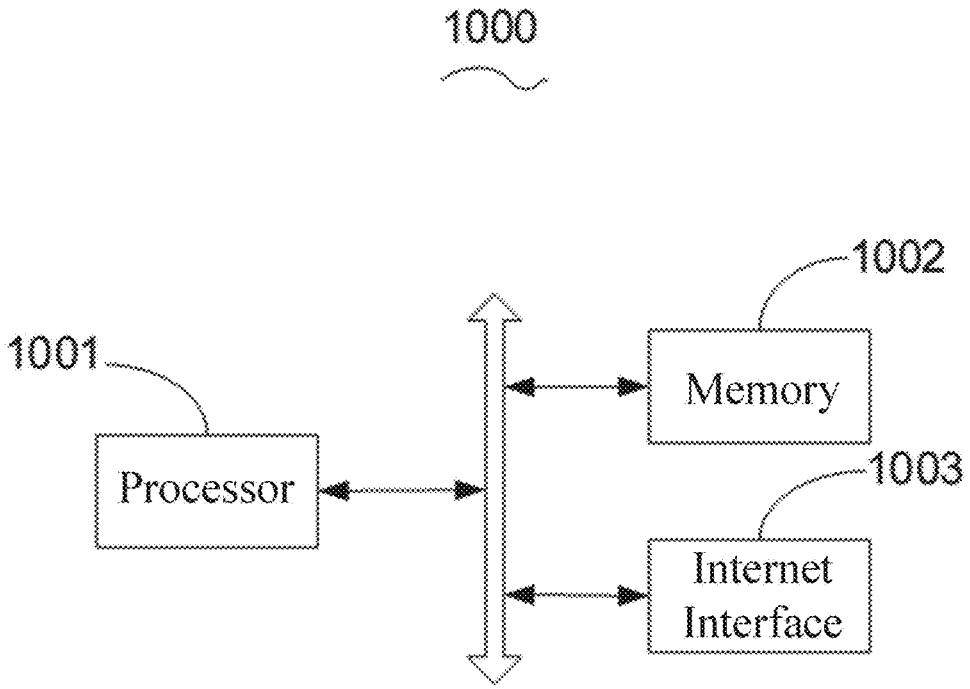
FIG. 7 is a structural diagram of an electronic device according to an embodiment of the present disclosure.

In a third aspect, referring to FIG. 7, FIG. 7 is a structural diagram of an electronic device according to an embodiment of the present disclosure. An embodiment of the present disclosure further provides an electronic device, including a processor and a memory. The memory stores computer instructions executable by the processor, and when the processor reads the computer instructions in the memory, steps in the above-mentioned in-vehicle independent sound zone control method are executed.

Specifically, the processor is configured to perform the following steps.

S01: a control area and a non-control area are preset. The control area refers to a listening area where passengers in the vehicle is located, to form an in-vehicle independent sound zone. The non-control area refers to the remaining area in the vehicle except the control area.

S02: a speaker array is arranged behind a front seat of the vehicle for generating a first acoustic response, a headrest speaker is arranged at a headrest of a rear seat of the vehicle for generating a second acoustic response response.

S03: a virtual target speaker is fitted, in which the virtual target speaker is configured to generate a target acoustic response in the control area.

S04: a sound quality of the in-vehicle independent sound zone is controlled through an audio algorithm processing on the target acoustic response, the first acoustic response and the second acoustic response.

The electronic device 1000 provided in the embodiment of the present disclosure can implement each of in the method embodiment and achieve the corresponding beneficial effects, which are not repeated herein to avoid repetition.

It should be pointed out that only 1001-1003 with components are shown in the figures, but it should be understood that it is not required to implement all of the shown components, and more or less components may be implemented instead. Those skilled in the art can understand that the electronic device 1000 herein is a device capable of automatically performing a numerical calculation and/or an information processing according to pre-set or stored instructions, and its hardware includes but is not limited to a microprocessors device, an application specific integrated circuit (ASIC), a Field-Programmable Gate Array (FPGA), a digital signal processor (DSP), or an embedded device.

The memory 1002 includes at least one type of readable storage medium, and the readable storage medium may be flash memory, hard disk, multimedia card, card-type memory (e.g., SD or DX memory), random access memory (RAM), static random access memory (SRAM), read only memory (ROM), electrically erasable programmable read only memory (EEPROM), programmable read only memory (PROM), magnetic memory, magnetic disk or optical disk. In some embodiments, the memory 1002 may be an internal storage unit of the electronic device 1000, such as a hard disk or a memory of the electronic device 1000. In other embodiments, the memory 1002 may also be an external storage device of the electronic device 1000, such as a pluggable hard disk, a smart memory card (SMC), secure digital (SD) card, and flash card. Of course, the memory 1002 may also include both an internal storage unit of the electronic device 1000 and an external storage device thereof. The computer instructions executable by the processor 1001 are stored on the memory 1002. In this embodiment, the memory 1002 is generally configured to store an operating system and various application software installed in the electronic device 1000, such as program codes of methods of the electronic device 1000. In addition, the memory 1002 may further be configured to temporarily store various types of data that have been output or will be output.

In some embodiments, the processor 1001 may be a central processing unit (CPU), a controller, a microcontroller, a microprocessor, or other data processing chips. The processor 1001 is generally configured to control an overall operation of the electronic device 1000. In this embodiment, the processor 1001 is configured to execute program codes or process data stored in the memory 1002, for example, execute program codes of the method in the electronic device 1000.

The network interface 1003 may include a wireless network interface or a wired network interface, and the network interface 1003 is generally configured to establish a communication connection between the electronic device 1000 and other electronic devices.

In a fourth aspect, an embodiment of the present disclosure further provides a computer-readable storage medium, where the computer-readable storage medium stores computer instructions, and when the computer instructions are executed by the processor, the steps of above-mentioned in-vehicle independent sound zone control method are implemented. The computer-readable storage medium can achieve the same technical effect, which will not be repeated herein to avoid repetition.

Those of ordinary skill in the art can understand that all or part of the process of the method in the electronic device 1000 in the embodiment may be completed by instructing the relevant hardware through the computer instructions. The computer instructions may be stored in a computer-readable storage medium. When the computer instructions are executed, it may include the flow of each of the embodiments of the method. The storage medium may be a magnetic disk, an optical disk, a read-only memory (ROM), or a random access memory (RAM).

The above descriptions are only embodiments of the present disclosure, and are not intended to limit the scope of the present disclosure. Any equivalent structure or equivalent process transformation made by using the contents of the description and drawings of the present disclosure, or directly or indirectly applied to other related technology fields are similarly included in the scope of patent protection of the present disclosure.

What is claimed is:

1. An in-vehicle independent sound zone control method, applied to a vehicle, comprising:

presetting a control area and a non-control area, wherein the control area is a listening area where a passenger is located in the vehicle and an in-vehicle independent sound zone is formed, and the non-control area is a remaining area in the vehicle except the control area;

arranging a speaker array behind a front seat of the vehicle for generating a first acoustic response, and arranging a headrest speaker at a headrest on a rear seat of the vehicle for generating a second acoustic response;

fitting a virtual target speaker, wherein the virtual target speaker is configured to generate a target acoustic response within the control area; and controlling a sound quality of the in-vehicle independent sound zone through a sound zone isolation processing and a sound zone sound quality optimization processing on the target acoustic response, the first acoustic response and the second acoustic response, wherein the sound zone isolation processing comprises maximizing a difference between the first acoustic response in the control area and the first acoustic response in the non-control area, and maximizing a difference between the second acoustic response in the control area and the second acoustic response in the non-controlled region, the sound zone sound quality optimization processing comprises performing a response fitting on the first acoustic response, the second acoustic response and the target acoustic response.

2. The in-vehicle independent sound zone control method of claim 1, wherein the speaker array comprises a plurality of speaker units, and the plurality of speaker units comprise a linear array or a circular array.

3. The in-vehicle independent sound zone control method of claim 1, wherein the step of fitting the virtual target speaker is specifically:

presetting a target position in the control area to fit a virtual speaker; comprehensively superimposing the first acoustic response and the second acoustic response within the preset target position of the control area, so as to realize the target acoustic response generated by the virtual speaker.

4. The in-vehicle independent sound zone control method of claim 1, wherein the response fitting is obtained by simultaneously combining a relationship between the target acoustic response and a transfer function.

* * * * *